US008413443B2

(12) United States Patent
Johnson

(10) Patent No.: US 8,413,443 B2
(45) Date of Patent: Apr. 9, 2013

(54) FLOW CONTROL THROUGH A RESONATOR SYSTEM OF GAS TURBINE COMBUSTOR

(75) Inventor: Clifford E. Johnson, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 492 days.

(21) Appl. No.: 12/638,005

(22) Filed: Dec. 15, 2009

(65) Prior Publication Data

US 2011/0138812 A1 Jun. 16, 2011

(51) Int. Cl.
*F02C 7/24* (2006.01)
*F23M 5/00* (2006.01)
*F02K 1/00* (2006.01)

(52) U.S. Cl.
USPC ..... 60/725; 431/114; 181/213

(58) Field of Classification Search ..... 60/725, 60/39.37, 752; 181/213, 222, 220, 224; 431/114
See application file for complete search history.

(56) References Cited

U.S. PATENT DOCUMENTS

| | | | | |
|---|---|---|---|---|
| 3,819,009 | A * | 6/1974 | Motsinger | 181/292 |
| 3,990,837 | A * | 11/1976 | Snell | 60/752 |
| 5,590,849 | A | 1/1997 | Pla | |
| 5,685,157 | A | 11/1997 | Pandalai et al. | |
| 6,018,950 | A | 2/2000 | Moeller | |
| 6,530,221 | B1 | 3/2003 | Sattinger et al. | |
| 6,550,574 | B2 | 4/2003 | Liu | |
| 6,837,051 | B2 | 1/2005 | Mandai et al. | |
| 7,080,514 | B2 | 7/2006 | Bland et al. | |
| 7,089,741 | B2 | 8/2006 | Ikeda et al. | |
| 7,413,053 | B2 | 8/2008 | Wasif et al. | |
| 2002/0088233 | A1 * | 7/2002 | Ohnishi et al. | 60/725 |
| 2006/0053798 | A1 | 3/2006 | Hadder | |
| 2007/0034447 | A1 | 2/2007 | Proscia et al. | |
| 2007/0169992 | A1 * | 7/2007 | Wasif et al. | 181/293 |
| 2008/0041058 | A1 | 2/2008 | Johnson et al. | |
| 2009/0013530 | A1 * | 1/2009 | Rudrapatna et al. | 29/888 |
| 2009/0084100 | A1 | 4/2009 | Johnson et al. | |
| 2009/0094985 | A1 | 4/2009 | Johnson et al. | |

FOREIGN PATENT DOCUMENTS

| | | | |
|---|---|---|---|
| EP | 1510757 | A2 | 3/2005 |
| WO | 2009038611 | A2 | 3/2009 |

* cited by examiner

*Primary Examiner* — Gerald Sung

(57) ABSTRACT

A resonator system for a turbine engine can improve acoustic performance and cooling effectiveness. During engine operation, a combustor liner exhibits alternating hot and cold regions in the circumferential direction corresponding to the non-uniform temperature distribution of the combustion flame. Accordingly, high flow resonators are formed with the liner in substantial alignment with the hot regions of the fluid flow within the liner, and low flow resonators are formed with the liner in substantial alignment with cold regions of the fluid flow within the liner. As a result, appropriate amounts of cooling can be provided to the liner so that cooling air usage is optimized. Alternatively or in addition, the liner can include two or more rows of resonators, which can provide an enhanced acoustic damping response. The resonators in the first row can be aligned with or offset from the resonators in the second row.

18 Claims, 6 Drawing Sheets

FLOW CONTROL THROUGH A RESONATOR SYSTEM OF GAS TURBINE COMBUSTOR

FIELD OF THE INVENTION

The invention generally relates to turbine engines, and more particularly to the use of resonators in turbine engines.

BACKGROUND OF THE INVENTION

A turbine engine has a compressor section, a combustor section and a turbine section. In operation, the compressor section can induct ambient air and compress it. The compressed air can enter the combustor section and can be distributed to each of the combustors therein. FIG. 1 shows one example of a known combustor 10. The combustor 10 can include a pilot swirler 12 (or more generally, a pilot burner). A plurality of main swirlers 14 can be arranged circumferentially about the pilot swirler 12. Fuel is supplied to the pilot swirler 12 and separately to the plurality of main swirlers 14 by fuel supply nozzles (not shown). When the compressed air 16 enters the combustor 10, it is mixed with fuel in the pilot swirler 12 as well as in the surrounding main swirlers 14. Combustion of the air-fuel mixture occurs downstream of the swirlers 12, 14 in a combustion zone 20, which can be largely enclosed within a combustor liner 22. As a result, a hot working gas is formed. The hot working gas can be routed to the turbine section, where the gas can expand and generate power that can drive a rotor.

During engine operation, acoustic pressure oscillations at undesirable frequencies can develop in the combustor section due to, for example, burning rate fluctuations inside the combustor section. Such pressure oscillations can damage components in the combustor section. To avoid such damage, one or more damping devices can be associated with the combustor section of a turbine engine. One commonly used damping device is a resonator 24, which can be a Helmholtz resonator. Various examples of Helmholtz resonators are disclosed in U.S. Pat. Nos. 6,530,221 and 7,080,514. Generally, a resonator 24 can be formed by attaching a resonator box 26 to a surface of a combustor section component, such as an outer peripheral surface 28 of the combustor liner 22. A plurality of resonators 24 can be aligned circumferentially about the liner 22.

Each resonator 24 can be tuned to provide damping at a desired frequency or across a range of frequencies. While many efforts in resonator design have been directed to optimizing the acoustic damping performance of resonators, there is still an ongoing need for a more effective and efficient resonator system.

In addition to acoustic damping, the resonators 24 can serve an important cooling function. A resonator plate 30 of the resonator box 26 can include a plurality of holes 32 through which air can enter and purge an internal cavity formed between the resonator box 26 and the liner 22. One beneficial byproduct of such airflow is that the air can pass through the holes 32 and directly impinge on the hot surface of the liner 22, thereby providing impingement cooling to the liner 22.

Further, the liner 22 can be perforated with holes 38. Each resonator box 26 is welded to the liner 22 around a group 39 of the holes 38. Thus, air entering the resonator 24 through the holes 32 in the resonator box 26 can exit the resonator 24 by flowing through the holes 38 in the liner 22. Such flow can provide a film cooling effect on the inner peripheral surface 40 of the liner 22.

However, there can be wide variation in the temperature distribution of the fluid flow 23, including the combustion flame, within the liner 22, which is due to the arrangement of the main swirlers 14. Specifically, the fluid flow 23 exhibits a pattern of alternating relatively hot temperature regions and relatively cold temperature regions in the circumferential direction, particularly at or near the inner peripheral surface 40 of the liner 22. For each main swirler 14, there is a corresponding hot region in the fluid flow. Each hot region may be generally aligned with a corresponding one of the main swirlers 14, but they can be offset due to the swirl angle. In between each pair of neighboring hot regions, the flame is relatively cold, thereby forming a cold region in the fluid flow. The difference in temperature between the hot and cold regions of the fluid flow 23 at or near the inner peripheral surface 40 of the liner 22 can be at least about 100 degrees Celsius. As the flame progresses downstream, the hot and cold regions of the fluid flow 23 can merge so that there is less of a temperature difference between the hot and cold regions in the fluid flow 23.

The liner 22 itself has alternating hot and cold regions in the circumferential direction generally corresponding to the temperature distribution of the fluid flow within the liner 22. The difference in temperature between the hot and cold regions of the liner 22 can be generally the same as the difference in temperature between the hot and cold regions of the fluid flow at or near the inner peripheral surface 40 of the liner 22. However, the difference in liner temperature between the hot and cold regions can be affected by a number of additional factors.

The placement of resonators based chiefly on acoustic considerations can lead to non-optimized cooling and possibly an increase in undesired emissions. For instance, if a resonator with a relatively high rate of airflow therethrough is provided in a cold region of the liner, then this portion of the liner is being overly cooled. The excess amount of cooling air results in higher combustion emissions of oxides of nitrogen (NOx). Instead of being wasted, such cooling air could be put to beneficial uses elsewhere in the engine. Likewise, if a resonator with a relatively low rate of airflow therethrough is provided in a hot region of the liner, then this portion of the liner may not be adequately cooled, potentially degrading the integrity of the liner.

Thus, there is a need for a resonator system that can improve the cooling effectiveness of the resonators and/or improve the acoustic performance of the resonators.

SUMMARY OF THE INVENTION

In one respect, aspects of the invention are directed to a resonator system for a turbine engine. The system includes a combustor component, which can be, for example, a combustor liner. The combustor component has an outer peripheral surface and an inner peripheral surface. A first plurality of holes extends through the combustor component from the outer peripheral surface to the inner peripheral surface. The first plurality of holes is distributed circumferentially about the combustor component. There is a fluid flow within the combustor component. The temperature of the fluid flow proximate to the inner peripheral surface of the combustor component has relatively hot regions alternating with relatively cold regions in the circumferential direction about the inner peripheral surface of the combustor component.

A first plurality of resonators is formed with the combustor component. Each resonator has a resonator plate and one or more side walls. The resonator plate includes a plurality of holes. The resonator plate can have any suitable shape. For example, the resonator plate can be generally trapezoidal, parallelogram, rectangular, circular, oval, elliptical or triangular in conformation. Each resonator has an inner cavity defined between the resonator plate, the at least one side wall and the outer peripheral surface of the combustor component. The at least one sidewall of each resonator surrounds a subset of the first plurality of holes. The first plurality of resonators is substantially circumferentially aligned about the combustor component to form a first row of resonators.

A portion of the resonators are high flow resonators, and a portion of the resonators are low flow resonators. Each high flow resonator is formed in a location that is substantially aligned with one of the relatively hot regions. Each low flow resonator is formed in a location that is substantially aligned with one of the relatively cold regions. The rate of flow through the high flow resonators can be from about 1.5 to about 5 times the rate of flow through the low flow resonators.

For at least one of the first plurality of resonators, the resonator plate and the one or more side walls can be formed as a resonator box. In such case, the one or more side walls of the resonator box can be attached to the outer peripheral surface of the combustor component so that the resonator box protrudes outwardly from the outer peripheral surface of the combustor component.

The first plurality of resonators can be arranged so that there is a single high flow resonator associated with each hot region and a single low flow resonator associated with each cold region. Thus, a single high flow resonator can alternate with a single low flow resonator about the outer peripheral surface of the combustor component.

The system can further include a second plurality of holes extending through the combustor component from the outer peripheral surface to the inner peripheral surface. The second plurality of holes can be distributed circumferentially about the combustor component. The second plurality of holes can be axially downstream of the first plurality of holes. A second plurality of resonators can be formed with the combustor component. Each resonator can have a resonator plate and at least one side wall. The resonator plate can include a plurality of holes. Each resonator can have an inner cavity defined between the resonator plate, the at least one side wall and the outer peripheral surface of the combustor component. The at least one side wall of each resonator can surround a subset of the second plurality of holes, that is, less than all of the second plurality of holes. The second plurality of resonators can be substantially circumferentially aligned about the combustor component to form a second row of resonators.

In one embodiment, each resonator in the first row of resonators can have substantially the same circumferential clocking position as a respective one of the resonators in the second row of resonators. Thus, the resonators in the first row can be substantially aligned with the resonators in the second row. In another embodiment, each resonator in the first row of resonators can have a different circumferential clocking position than a respective one of the resonators in the second row of resonators. Thus the resonators in the first row are offset from the resonators in the second row.

The resonators in the first row of resonators can collectively have an associated first damping characteristic. The resonators in the second row of resonators can collectively have an associated second damping characteristic. The first damping frequency characteristic can be different from the second damping frequency characteristic.

The second row of resonators can include a plurality of high flow resonators and low flow resonators. The rate of flow through the high flow resonators can be from about 1.5 to about 5 times the rate of flow through the low flow resonators.

In another respect, aspects of the invention are directed to a resonator system for a turbine engine. The system includes a combustor component, which can be a combustor liner. The combustor component has an outer peripheral surface and an inner peripheral surface. A first plurality of holes extends through the combustor component from the outer peripheral surface to the inner peripheral surface. The first plurality of holes is distributed circumferentially about the combustor component. A second plurality of holes extends through the combustor component from the outer peripheral surface to the inner peripheral surface. The second plurality of holes is distributed circumferentially about the combustor component. The second plurality of holes are located axially downstream of the first plurality of holes.

A first plurality of resonators is formed with the combustor component. The first plurality of resonators is substantially circumferentially aligned about the combustor component to form a first row of resonators. Each resonator has a resonator plate and at least one side wall. A plurality of holes is included in the resonator plate. Each resonator has an inner cavity defined between the resonator plate, the at least one side wall and the outer peripheral surface of the combustor component. The at least one side wall of each resonator surrounds some of the first plurality of holes in the combustor component. The resonator plate of each of the first plurality of resonators can be generally trapezoidal, generally parallelogrammatic, generally rectangular, or generally triangular in conformation.

A second plurality of resonators is formed with the combustor component. The second plurality of resonators is substantially circumferentially aligned about the combustor component to form a second row of resonators. Each resonator has a resonator plate and at least one side wall. A plurality of holes is included in the resonator plate. Each resonator has an inner cavity defined between the resonator plate, the at least one side wall and the outer peripheral surface of the combustor component. The at least one side wall of each resonator surrounds some of the second plurality of holes in the combustor component. The resonator plate of each of the second plurality of resonators can be generally trapezoidal, generally parallelogrammatic, generally rectangular, or generally triangular in conformation.

Each resonator in the first row of resonators can have substantially the same circumferential clocking position as a respective one of the resonators in the second row of resonators. As a result, the resonators in the first row can be substantially aligned with the resonators in the second row. Alternatively, each resonator in the first row of resonators can have a different circumferential clocking position than a respective one of the resonators in the second row of resonators. As a result, the resonators in the first row are offset from the resonators in the second row. In one embodiment, a resonator in the second row can be offset from a resonator in the first row by about one half of a circumferential width of the resonator in the first row.

The resonators in the first row of resonators can collectively have an associated first damping characteristic, and the resonators in the second row of resonators can collectively have an associated second damping characteristic. The first damping characteristic can be different from the second damping characteristic. Both the first and second damping characteristics can be frequency dependent characteristics.

In another respect, aspects of the invention relate to a method of positioning resonators in a turbine engine. A combustor component is provided. The combustor component has an outer peripheral surface and an inner peripheral surface. The combustor component also has an associated circumferential direction. A fluid flow passes through the combustor component. The fluid flow proximate to the inner peripheral surface of the combustor component has relatively hot regions alternating with relatively cold regions in the circumferential direction about the inner peripheral surface of the combustor component.

According to the method, the location of a hot region of the fluid flow is determined and a high flow resonator is formed with the combustor component based on the determined location of the hot region such that high flow resonator is substantially aligned with the hot region.

The location of a cold region of the fluid flow can also be determined. A low flow resonator can be formed with the combustor component based on the determined location of the cold region such that the low flow resonator is substantially aligned with the cold region.

DETAILED DESCRIPTION OF EMBODIMENTS OF THE INVENTION

Embodiments of the invention are directed to resonator systems adapted to improve their cooling effectiveness and/or acoustic performance. Aspects of the invention will be explained in connection with various resonator configurations, but the detailed description is intended only as exemplary. Embodiments of the invention are shown in FIGS. 2-10, but the present invention is not limited to the illustrated structure or application.

Figure 1:
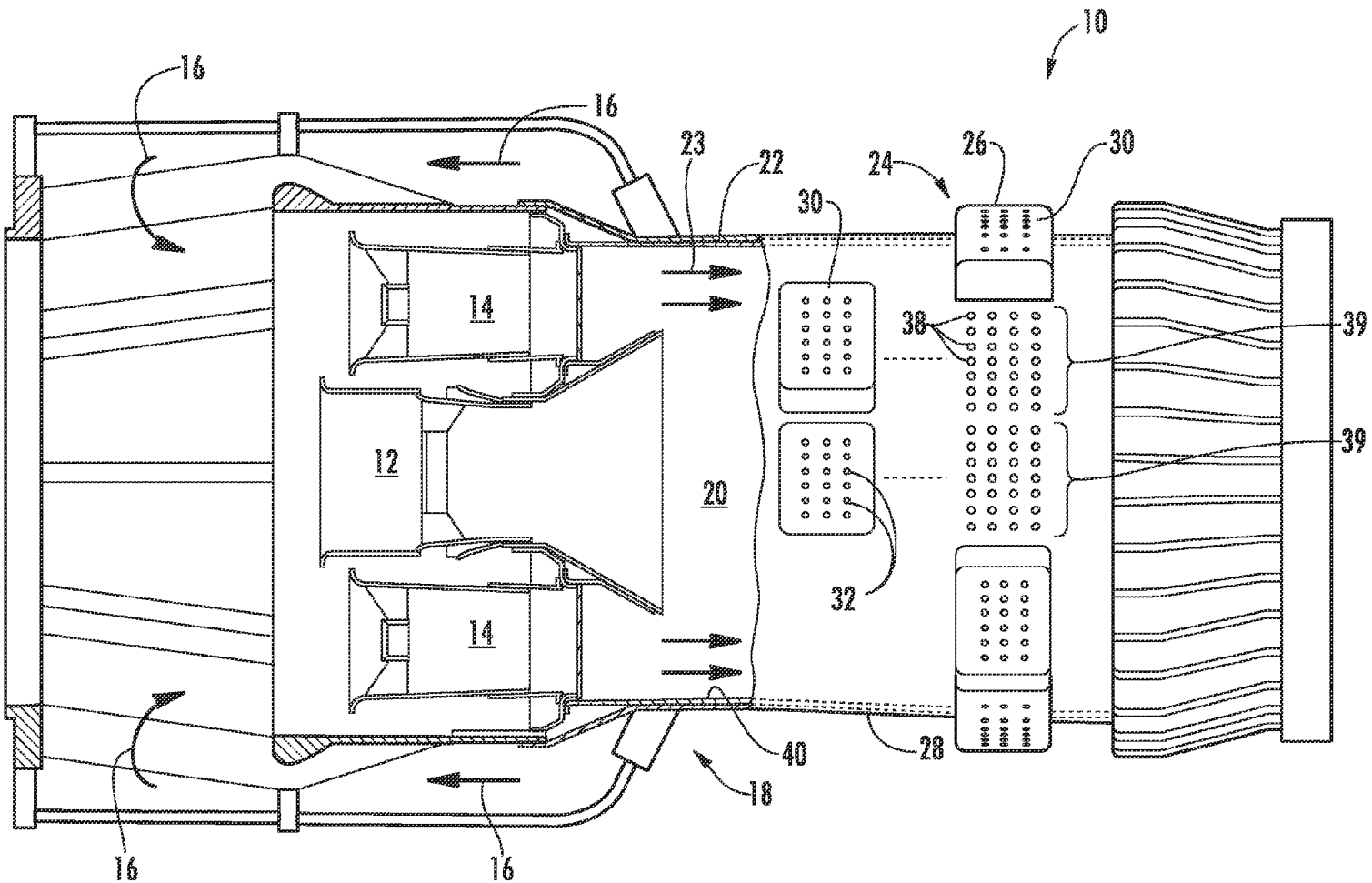
FIG. 1 (PRIOR ART)
FIG. 1 is a side elevation view of a prior art combustor, partly in cross-section to show the interior of the combustor and partly exploded to show holes in the combustor liner.
Figure 2:
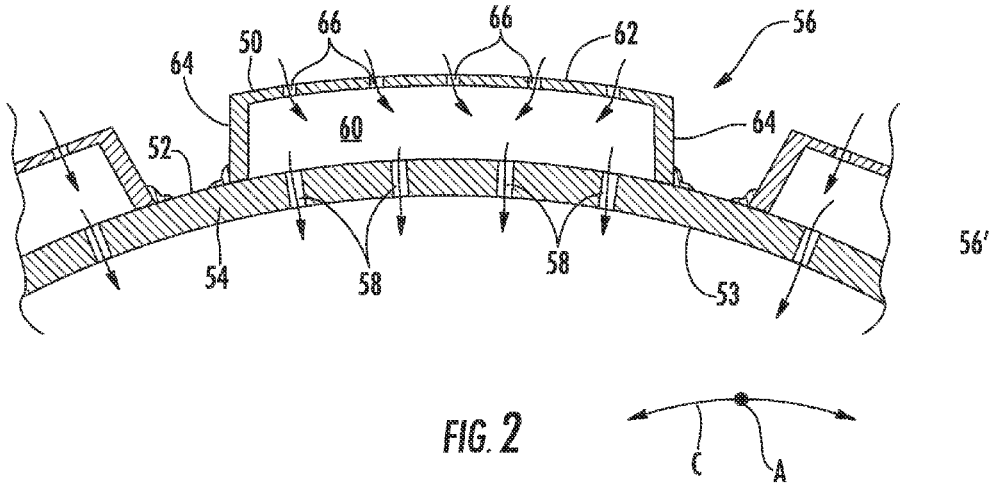
FIG. 2 is a side elevation cross-sectional view of a resonator.

As is shown in FIG. 2, one or more damping devices can be formed with a surface of a combustor component. For example, a plurality of resonators 50 can be formed with an outer peripheral surface 52 of a combustor component, such as a liner 54 or a transition duct, to thereby form a plurality of resonators 56. The liner 54 can also have an inner peripheral surface 53. The liner 54 can be substantially cylindrical in conformation. The liner 54 can have an associated axial direction A and circumferential direction C relative to the direction of fluid flow within the liner 54 during engine operation. A plurality of holes 58 can be formed in the liner 54.

Figure 8:
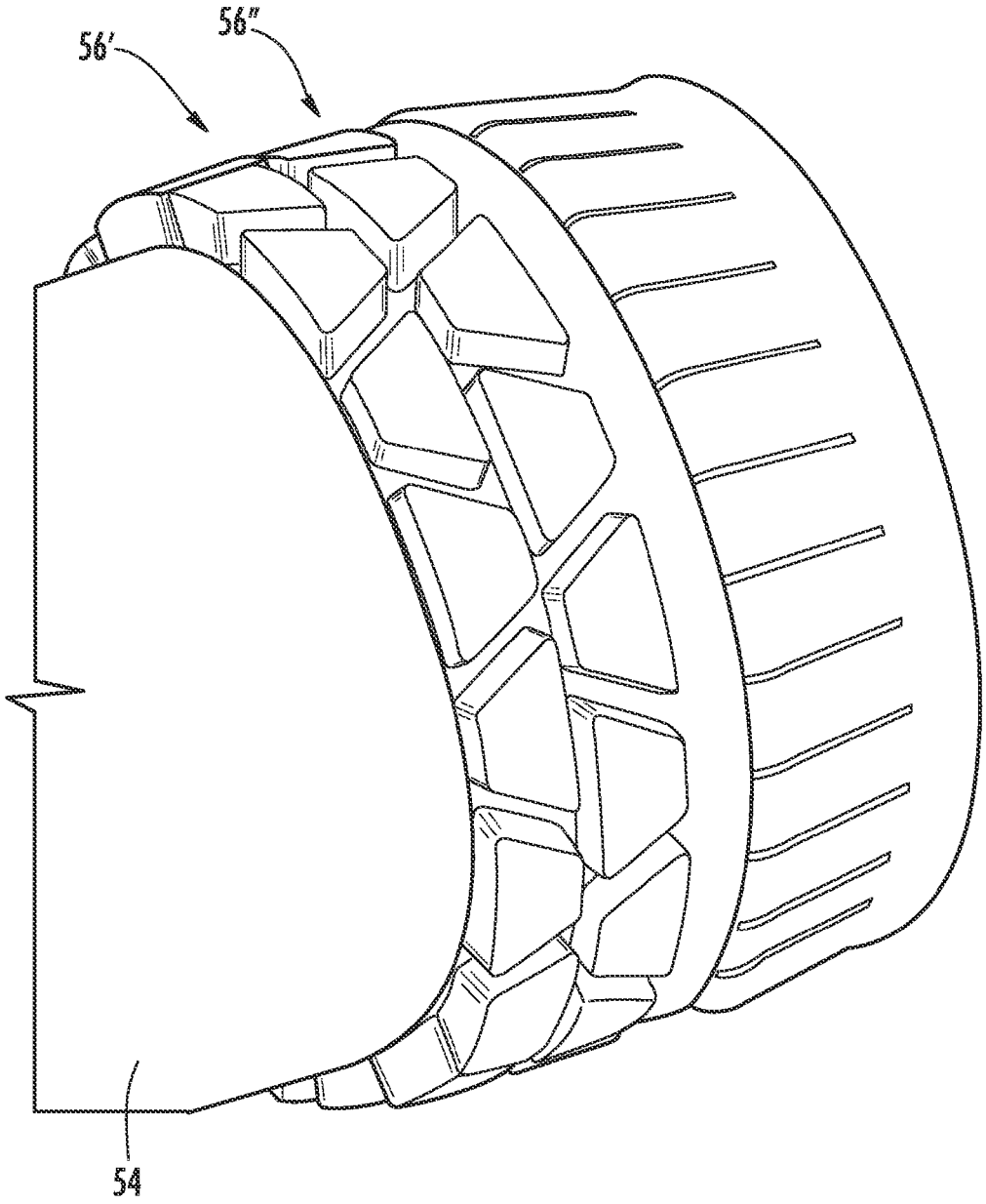
FIG. 8 is a perspective view of a combustor liner having two rows of resonators thereon.

The plurality of resonators 56 can be distributed circumferentially about the outer peripheral surface 52 of the liner 54. In one embodiment, the resonators 56 can be substantially equally spaced about the liner 54. The resonators 56 can be substantially circumferentially aligned so that a first row of resonators 56' is formed (FIG. 8). The resonators 56 in the first row 56' can be identical to each other, or at least one of the resonators 56 can be different from the other resonators 56 in at least one respect, including, for example, height, width, length, volume, shape, frequency damping characteristic, and mass flow rate therethrough, just to name a few possibilities.

The resonators 50 can have any suitable form. Generally, the resonators 50 can include a resonator plate 62 and one or more side walls 64. The resonator plate 62 can be substantially flat, or it can be curved. A plurality of holes 66 can extend through the resonator plate 62. The holes 66 can have any cross-sectional shape and size. For instance, the holes 66 can be circular, oval, rectangular, triangular, or polygonal. Each of the holes 66 can have a substantially constant cross-sectional area along its length. The holes 66 can be substantially identical to each other, or at least one of the holes 66 can be different from the other holes 66 in one or more respects. The holes 66 can be arranged on the resonator plate 62 in various ways. In one embodiment, the holes 66 can be arranged in rows and columns. The resonator plate 62 may include impingement cooling tubes (not shown), examples of which are described in U.S. Pat. No. 7,413,053, which is incorporated herein by reference.

The at least one side wall 64 can extend from each side of the resonator plate 62 at or near the periphery of the resonator plate 62. The one or more side walls 64 can generally extend about entire periphery of the resonator plate 62. As a result, the sides of the resonator 50 can be generally closed. That is, the side walls 64 of the resonator 50 may have no holes extending therethrough. However, in some instances, there may be one or more holes (not shown) extending through one or more of the side walls 64. In one embodiment, the one or more side walls 64 can be substantially perpendicular to the resonator plate 62. Alternatively, the one or more side walls 64 may be non-perpendicular to the resonator plate 62.

The one or more side walls 64 of the resonator 50 can be formed in any suitable manner. In one embodiment, the resonator plate 62 and the at least one side wall 64 can be formed as a unitary structure, such as by casting or stamping. Alternatively, the at least one side wall 64 can be made of one or more separate pieces, which can be attached to the resonator plate 62 and/or to each other in any suitable manner, such as by welding, welding, brazing or mechanical engagement. In either case, a resonator box can be formed. The side walls 64 can be attached to the outer peripheral surface 52 of the liner 54 such that the one or more side walls 64 and resonator plate 62 protrude outwardly from the outer peripheral surface 52 of the liner 54, as shown in FIG. 2.

In another embodiment, the side walls 64 can be formed by the liner 54 itself. For instance, a recess (not shown) can be formed in the outer peripheral surface 52 of the liner 54. The side walls of the recess can form the side wall of the resonator. The holes 58 can be formed in the bottom wall of the recess. In such resonator configuration, the resonator plate 62 can be attached directly to the outer peripheral surface 52 of the liner 54. In such case, the resonator plate 62 would be the only portion of the resonator 50 that extends outwardly from the outer peripheral surface 52 of the liner 54.

Regardless of the manner in which the one or more side walls 64 are formed, the one or more side walls 64 can surround at least some of the plurality of holes 58 in the liner 54. The resonator 56 can include an inner cavity 60, which can be defined between the resonator plate 62, the one or more side walls 64 and the liner 54.

Each of the resonators 56 can be configured to provide the desired fluid flow therethrough. The mass flow rate through the resonators 56 can be tuned to provide the desired acoustic performance while maintaining acceptable combustor liner temperatures. The mass flow rate can be based on a number of factors including, for example, the size and quantity of holes 66, the size and quantity of holes 58, the size of the inner cavity 60, and the height of the resonator 54.

Figure 3:
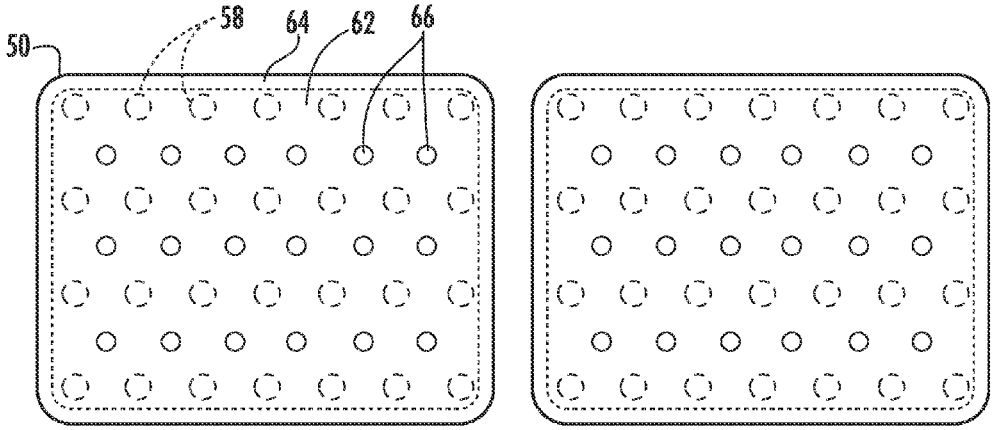
FIG. 3 is a top plan view of a resonator having a generally rectangular conformation.
Figure 4:
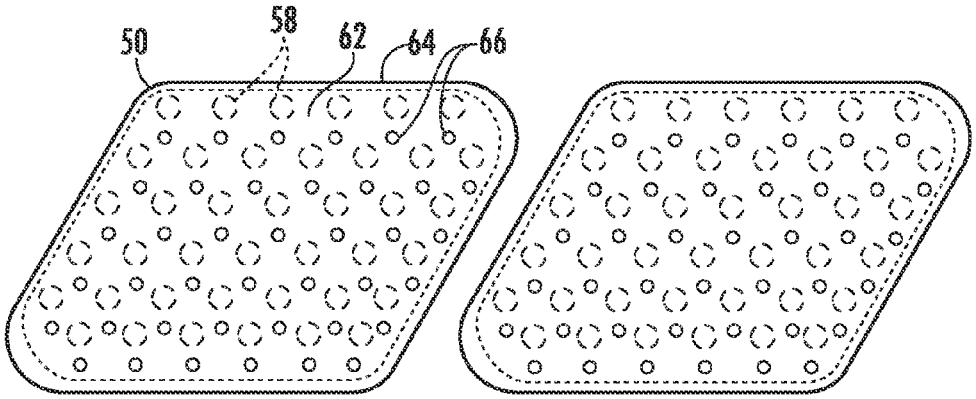
FIG. 4 is a top plan view of a resonator having a generally parallelogrammatic conformation.
Figure 5:
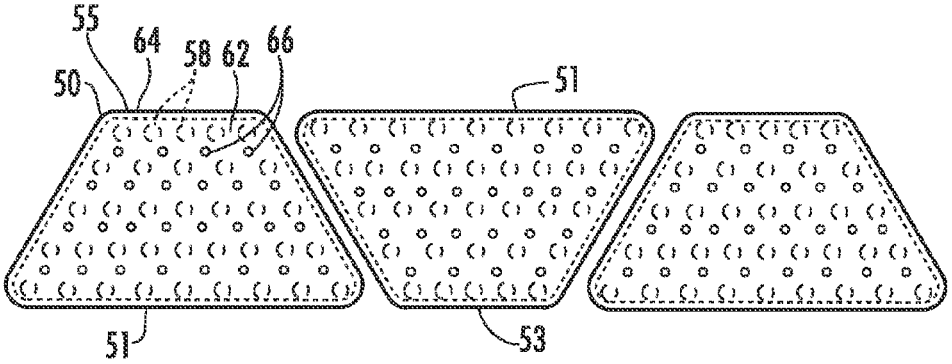
FIG. 5 is a top plan view of a resonator having a generally trapezoidal conformation.
Figure 6:
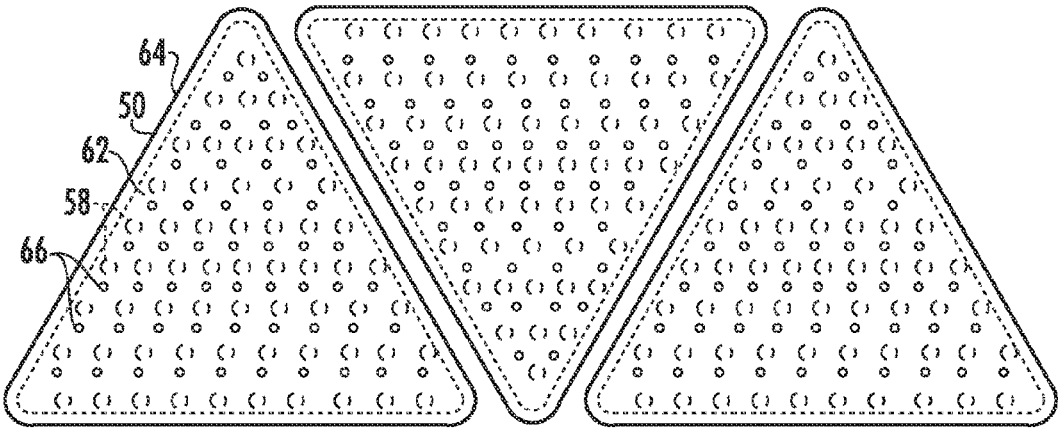
FIG. 6 is a top plan view of a resonator having a generally triangular conformation.

The resonators 56 can have any suitable shape. For instance, the resonator plate 62 can be generally rectangular, as is shown in FIG. 3 and as is disclosed in U.S. Pat. No. 6,530,221, which is incorporated herein by reference. Alternatively, the resonator plate 62 can be generally parallelogramatic (FIG. 4) or generally trapezoidal (FIG. 5) in conformation, examples of which are disclosed in U.S. Patent Application Publication No. 2009/0094985, the disclosure of which is incorporated herein by reference. In one embodiment, the resonator plate 62 can be generally triangular in shape, as is shown in FIG. 6. Naturally, the one or more side walls 64 and/or the holes 58 in the liner 54 can be configured accordingly to cooperate with such conformations of the resonator plate 62.

The resonators 56 can be oriented in any suitable manner. In one embodiment, the resonators 56 can be oriented in the same direction. However, in other embodiments, one or more of the resonators 56 can be oriented in a different direction from one or more of the other resonators. For instance, as shown in FIG. 5, trapezoidal-shaped resonators can be arranged such that some of the resonators 56 have their long base sides 51 facing in the axial upstream direction and such that some of the resonators 56 have their short base side 55 facing the axial upstream direction. The resonators 56 can be arranged so that the resonators 56 are oriented in the same manner, such as shown, for example, in FIGS. 3 and 4.

Figure 7:
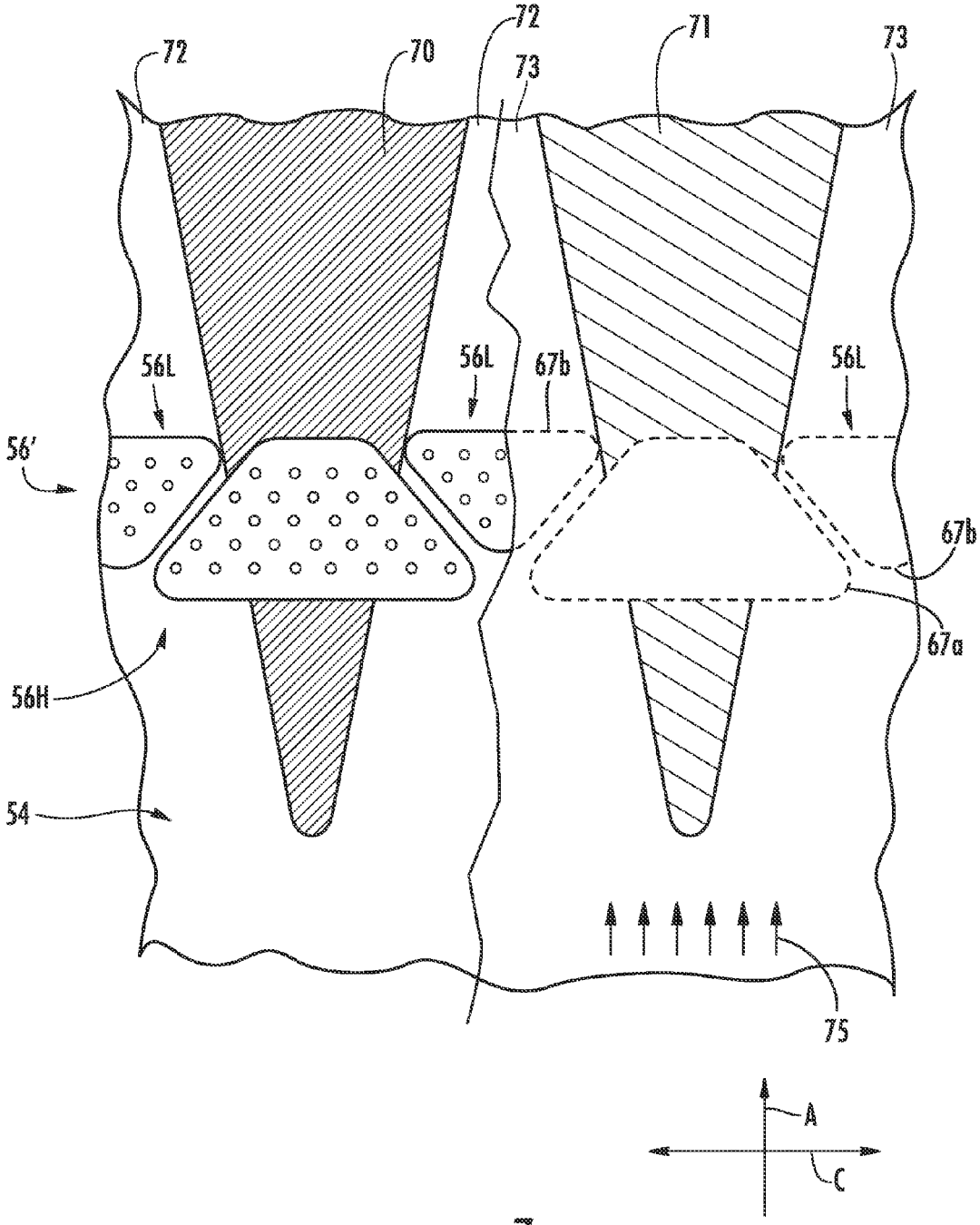
FIG. 7 is a top plan view of a combustor liner partially broken away, showing high flow resonators positioned in substantial alignment with the hot regions and low flow resonators positioned in substantial alignment with the cold regions of a fluid flow within the liner.

Referring to FIG. 7, the combustor liner 54 can include relatively hot temperature regions 70 alternating with relatively cold temperature regions 72 in the circumferential direction C of the liner 54. As noted above, these relatively hot temperature regions 70 and relatively cold temperature regions 72 arise due to the non-uniform temperature of the fluid flow 75, including the combustor flame (not shown), within the liner 54. The location of each relatively hot region 70 of the liner generally corresponds to a respective hot region 71 of the fluid flow 75 proximate to the inner peripheral surface 53 of the liner 54. Likewise, the location of each relatively cold region 72 of the liner 54 generally corresponds to a respective cold region 73 in the fluid flow 75 proximate to the inner peripheral surface 53 of the liner 54.

The relatively hot temperature regions 71 and relatively cold temperature regions 73 of the fluid flow 75 alternate in the circumferential direction C about the inner peripheral surface 53 of the combustor liner 54. The use of the terms "relatively hot region" and "relatively cold region" herein is merely for convenience to distinguish between different temperature regions of the fluid flow 75 and to generally indicate the relative temperatures between them. It will be understood that the "cold region" is actually at a high temperature during engine operation, but the temperature is less than that of the "hot region." In some instances, the difference in temperature between the relatively hot region 71 and the relatively cold region 73 of the fluid flow 75 can be at least about 100 degrees Celsius.

The hot and cold regions 70, 72 of the liner 54 can have almost any shape or contour, regular or irregular. FIG. 7 shows the hot and cold regions 70, 72 as being generally triangular, but the regions 70, 72 are not limited to such shape. The relatively hot regions 70 of the liner 54 may all have substantially the same shape, or at least one of the hot regions 70 can have a different shape from the other relatively hot regions 70. Likewise, the relatively cold regions 72 of the liner 54 may all have substantially the same shape, or at least one of the relatively cold regions 72 can have a different shape from the other relatively cold regions 72. The general shape or contours of each hot and cold region 70, 72 can be determined in any suitable manner, such as by actual measurements or by modeling. The above description of the relatively hot and cold regions 70, 72 of the liner 54 can apply equally to the relatively hot and cold regions 71, 73 of the fluid flow 75.

According to aspects of the invention, the resonators 56 can be selectively positioned on the liner 54 based on the location of the hot and cold regions 70, 72 of the liner 54 and/or based on the location of the hot and cold regions 71, 73 of the fluid flow 75 within the liner 54. For each region 70, 72 of the liner 54 and/or each region 71, 73 of the fluid flow 75, one or more resonators 56 can be selected with an appropriate mass flow rate to provide sufficient cooling to the liner 54. Generally, one or more resonators 56H with a high mass flow rate can be provided on the liner 54 so as to be substantially aligned with each of the relatively hot regions 71 of the fluid flow 75 proximate to the inner peripheral surface 53 of the liner 54. One or more resonators 56L with a low mass flow rate can be provided on the liner 54 so as to be substantially aligned with each of the cold regions 73 of the fluid flow 75 proximate to the inner peripheral surface 53 of the liner 54. Thus, the high flow resonators 56H can alternate with the low flow resonators 56L in the circumferential direction about the liner 54. Again, the resonators 56H, 56L can be arranged in a circumferential row 56' about the liner 54. The high flow and low flow resonators 56H, 56L can all be substantially the same size, or they may have different sizes, as shown in FIG. 7.

"Aligned with" means that if an imaginary projection 67*a* (for high flow resonators 56H), 67*b* (for low flow resonators 56L) of the at least one side wall 64 of each resonator were superimposed onto the inner peripheral surface 53 of the liner 54, then at least a substantial portion of the imaginary projection 67*a*, 67*b* would be within the region 71 or 73, respectively. The resonators 56 can be aligned with the hot and cold regions 70, 72 of the liner 54 and/or the hot and cold regions 71, 73 of the fluid flow 75 in any suitable manner. For instance, each resonator 56 can be positioned so as to be substantially centered in the respective hot or cold region 71, 73 of the fluid flow 75 and/or the hot or cold region 70, 72 of the liner 54. Further, a portion of one or more of the resonators 56 may extend into at least a portion of one or more neighboring regions. For instance, each of the high flow resonators 56H shown in FIG. 7 can extend across their respective hot region 71 of the fluid flow 75 and into a portion of each of the cold regions 73 on either side of the hot region 71 of the fluid flow 75. Alternatively or in addition, each of the high flow resonators 56H shown in FIG. 7 can extend across their respective hot region 70 of the liner 54 and into a portion of each of the cold regions 72 of the liner 54 on either side of the hot region 70. However, in some instances, a resonator may be confined entirely within one of the regions 71, 73 of the fluid flow 75 and/or one of the regions 70, 72 of the resonator 54. For instance, each of the low flow resonators 56L shown in FIG. 7 are confined within the cold region 73 of the fluid flow 75 and/or the cold region 72 of the liner 54.

The high flow resonators 56H and the low flow resonators 56L can be arranged to provide adequate cooling to each region 70, 72 of the liner 54 to ensure that the temperature of the liner 54 does not exceed a critical level for each region.

The flow rates of individual resonators may be configured to provide the required local cooling while also providing the required acoustic damping and to minimize cooling air usage to reduce the combustor emissions. The critical temperature level can depend upon a number of factors, including the liner material, thermal barrier coatings, mechanical stresses, etc.

Each of the high flow resonators 56H can have a higher mass flow rate than the low flow resonators 56L. For instance, the mass flow rate of the high mass flow resonators 56H can be from about 1.5 to about 5 times greater than the mass flow rate of the low mass flow resonators 56L. In one embodiment, the mass flow rate of the high mass flow resonators 56H can be about 3 times greater than the mass flow rate of the low mass flow resonators 56L. Generally, in the row of resonators 56', the low flow resonator with the highest mass flow rate can have a mass flow rate that is less than the flow rate of the high flow resonator with the lowest mass flow rate.

The high flow resonators 56H in the first row 56' can be substantially identical to each other, or at least one of the high flow rate resonators 56H can be different in one or more respects, including, for example, in size, shape, mass flow rate, height, length, width, orientation, quantity of resonator plate holes and/or quantity of liner holes, just to name a few possibilities. Similarly, the low mass flow rate resonators 56L in the first row 56' can be substantially identical to each other, or at least one of the high flow rate resonators 56L can be different in one or more respects, including any of those listed above. Further, the quantity of high mass flow rate resonators 56H associated with each hot region 71 of the fluid flow 75 and/or each hot region 70 of the liner 54 can be equal. For instance, as shown in FIG. 7, there can be a single high mass flow resonator 56H associated with each hot region 71 of the fluid flow 75 and/or of the each hot region of the hot region 70 of the liner 54. However, in some instances, there can be more than one high mass flow resonator 56H associated with at least one of the hot regions 71 of the fluid flow 75 and/or at least one of the hot regions 70 of the liner 54. Likewise, the quantity of low mass flow rate resonators 56L used in each cold region 73 of the fluid flow 75 and/or each cold region 72 of the liner 54 can be equal. For instance, there can be a single low mass flow resonator 56L in each cold region 73 of the fluid flow 75 and/or each cold region 72 of the liner 54. However, in some instances, there can be more than one low mass flow resonator 56L associated with at least one of the cold regions 73 of the fluid flow 75 and/or each cold region 72 of the liner 54. In one embodiment, there can be a single high flow resonator 56H associated with each hot region 71 of the fluid flow 75 and/or of the each hot region of the hot region 70 of the liner 54, and there can be a single low flow resonator 56L associated with each cold region 73 of the fluid flow 75 and/or each cold region 72 of the liner 54.

In addition to being selected based on their associated mass flow rates, the resonators 54 can be selected based on size and/or shape for a suitable fit with the shape of the hot and/or cold regions 70, 72 of the liner 54 and/or of the hot and/or cold regions 71, 73 of the fluid flow 75. As is shown in FIG. 7, the plurality of high flow resonators 56H can be generally trapezoidal shaped, and the plurality of low flow resonators 56L can be generally triangular shaped. However, it will be understood that this configuration is merely an example, as other combinations and arrangements of resonators is possible within the scope of the invention.

Thus, during engine operation, the high flow resonators 56H can allow a greater quantity of cooling air to pass therethrough compared to the low flow resonators 56L. Consequently, the hot regions 70 of the liner 54 are better cooled than in previous resonator systems, while the low flow resonators provide less yet sufficient cooling to the cold regions 72 of the liner 54. As a result, the unnecessary use of air is minimized and the cooling of the liner can be improved.

While resonators can be placed according to the location of hot and cold regions 70, 72 of the liner 54 and/or according to the location of the hot and cold regions 71, 73 of the fluid flow 75, as described above, such placement may not necessarily be acoustically optimal. Therefore, alternatively or in addition to the placement of resonators 54 in line with the hot and cold regions 70, 72 of the liner 54 and/or the hot and cold regions 71, 73 of the fluid flow 75, a resonator system according to aspects of the invention can include a plurality of rows of resonators. By providing additional rows of resonators, the system can provide an enhanced acoustic damping response in the circumferential and/or axial directions. A plurality of rows of resonators may achieve more uniform acoustic coverage than would otherwise be available with a single row of resonators.

For convenience, the following description will concern a system having two rows of resonators (first row 56' and second row 56"), as is shown in FIG. 8. However, it will be understood that embodiments of the invention are not limited to two rows. Indeed, some resonator systems in accordance with aspects of the invention can have more than two rows of resonators. Further, some resonator systems in accordance with aspects of the invention may only have a single row of resonators.

Referring to FIG. 8, a resonator system can include a first row of resonators 56' and a second row of resonators 56". The second row of resonators 56" can be located axially downstream of the first row of resonators 56'. The spacing between the first and second row of resonators 56', 56" can be optimized for the acoustic modes shapes that are present in a particular system; however, this distance should be minimized to enhance the film cooling effectiveness from the first row of resonators 56'. The foregoing description of resonators can apply equally to the resonators in the first and second rows of resonators 56', 56". Naturally, the liner 54 can include a second plurality of holes, as is shown in FIG. 9.

Figure 9:
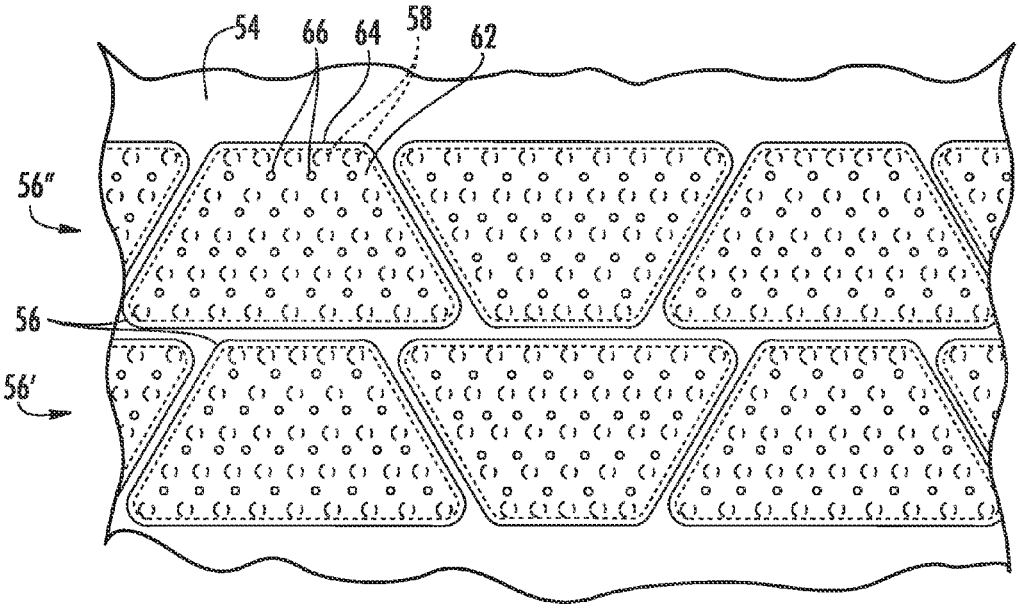
FIG. 9 is a top plan view of a combustor liner having two rows of resonators, wherein a first row of resonators is substantially aligned with a second row of resonators.
Figure 10:
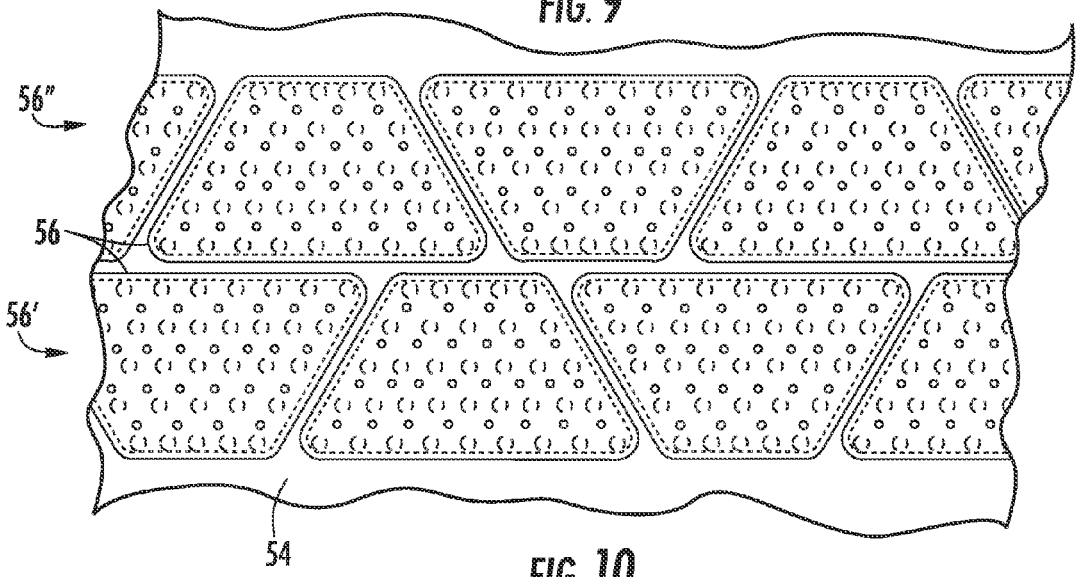
FIG. 10 is a top plan view of a combustor liner having two rows of resonators, wherein a first row of resonators is offset from a second row of resonators.

In one embodiment, the resonators in the first row 56' can be substantially aligned with the resonators 56" in the second row, as is shown in FIG. 9. As a result, each resonator in the first row 56' can be substantially aligned with a respective one of the resonators in the second row 56". That is, each resonator in the first row 56' can have the same circumferential clocking position on the liner 54 as a respective one of the resonators in the second row 56". Alternatively, one or more of the resonators in the second row 56" can be offset from the resonators in the first row 56', as is shown in FIG. 10. That is, each resonator in the first row 56' can have a circumferential clocking position on the liner 54 that is different from the clocking position of a respective one of the resonators in the second row 56". Any suitable offset can be used. In one embodiment, at least one of the resonators in the second row 56" can be offset from a respective one of the resonators in the first row 56' by about one half of the circumferential width of a resonator in the first row 56', as is shown in FIG. 10.

The resonators in the first row 56' can be substantially identical to the resonators in the second row 56". Alternatively, one or more of the resonators in the second row 56" can be different than the resonators in the first row 56' in one or more respects. For example, the first row of resonators 56' can collectively have an associated first acoustic damping characteristic, and the second row of resonators 56" can collectively have an associated second acoustic damping characteristic. The first and second acoustic damping characteristics can be tuned to dampen a specific target frequency or over a target range of frequencies. In one embodiment, the first acoustic damping characteristic can be different from the second acoustic damping characteristic in at least one respect. The first and second acoustic damping characteristics can be identical.

The first and second row of resonators 56', 56" may or may not include combinations of high and low flow resonators, as described above. The resonators in the second row 56" may not need to provide as much cooling flow as the first row of resonators 56' because of the upstream film cooling benefit provided by the first row of resonators 56'. If the high and low flow resonators 56H, 56L are provided in the second row 56", then the rate of flow through the high flow resonators 56H can be from about 1.5 to about 5 times the rate of flow through the low flow resonators 56L.

In view of the foregoing, it will be appreciated that a resonator system according to aspects of the invention can damp high frequency combustor dynamic modes. The resonator system can also maintain liner temperatures within acceptable limits. It should be noted that resonator systems having a plurality of rows of resonators in accordance with aspects of the invention can provide appreciable acoustic damping benefits. Aspects of the invention in which a plurality of rows of resonators are provided are not limited to embodiments in which one or both of the rows are placed in the hot and cold regions of the liner and/or the fluid flow.

It will be appreciated that a resonator system according to aspects of the invention can provide significant advantages over prior resonator systems. For instance, the peak temperature of the liner in regions beneath the resonator plates can be reduced by arranging higher flow resonators in line with the hot regions of the liner and/or the fluid flow. Further, the positioning of high flow resonators in cold regions can be avoided, thereby minimizing the production of unwanted emissions. Further, thermal stress of the liner in the area under the resonator plates is reduced due to a more uniform temperature distribution. In addition, the heat load on downstream portions of the liner and on components engaging the liner can be lowered.

Alternatively or in addition, the resonator system according to aspects of the invention can provide a more complete circumferential coverage of acoustic modes for the two resonator row design. Further, the resonator system can minimize the total airflow through all of the resonators, thereby allowing air to be put to other beneficial uses in the engine. Moreover, the minimization of airflow can result in an appreciable reduction in combustion emissions.

It should be noted that resonators according to aspects of the invention have been described herein in connection with a combustor liner, but it will be understood that the resonators can be used in connection with any component of the combustor section of the engine that may be subjected to undesired acoustic energy. The resonators can also be used in connection with any component of the combustor section that may be subjected to appreciable thermal gradients. While aspects of the invention are particularly useful in power generation applications, it will be appreciated that aspects of the invention can be application to other applications in which turbine engines are used. Thus, it will of course be understood that the invention is not limited to the specific details described herein, which are given by way of example only, and that various modifications and alterations are possible within the scope of the invention as defined in the following claims.

What is claimed is:

1. A resonator system for a turbine engine comprising:

a combustor component having an outer peripheral surface and an inner peripheral surface, a first plurality of holes extending through the combustor component from the outer peripheral surface to the inner peripheral surface, the first plurality of holes being distributed circumferentially about the combustor component;

a fluid flow within the combustor component, the fluid proximate to the inner peripheral surface of the combustor component having relatively hot regions alternating with relatively cold regions in the circumferential direction about the inner peripheral surface of the combustor component, and a first plurality of resonators formed with the combustor component, each resonator having a resonator plate and at least one side wall, the resonator plate including a plurality of holes therein, each resonator having an inner cavity defined between the resonator plate, the at least one side wall and the outer peripheral surface of the combustor component, the at least one sidewall of each resonator surrounding a subset of the first plurality of holes, the first plurality of resonators being substantially circumferentially aligned about the combustor component to form a first row of resonators, wherein a portion of the resonators are high flow resonators, wherein each high flow resonator is formed in a location that is substantially aligned with one of the relatively hot regions, wherein a portion of the resonators are low flow resonators, wherein each low flow resonator is formed in a location that is substantially aligned with one of the relatively cold regions, and wherein the first plurality of resonators are arranged so that there is a single high flow resonator associated with each hot region and a single low flow resonator associated with each cold region, whereby a single high flow resonator alternates with a single low flow resonator about the outer peripheral surface of the combustor component.

2. The resonator system of claim 1 wherein the rate of flow through the high flow resonators is from 1.5 to 5 times the rate of flow through the low flow resonators.

3. The resonator system of claim 1 wherein the combustor component is a combustor liner.

4. The resonator system of claim 1 wherein the shape of the resonator plate is one of generally trapezoidal, parallelogrammatic, rectangular, circular, oval, elliptical or triangular in conformation.

5. The resonator system of claim 1 wherein, for at least one of the first plurality of resonators, the resonator plate and the at least one side wall are formed as a resonator box, the at least one side wall of the resonator box being attached to the outer peripheral surface of the combustor component so that the resonator box protrudes outwardly from the outer peripheral surface of the combustor component.

6. The resonator system of claim 1 further including a second plurality of holes extending through the combustor component from the outer peripheral surface to the inner peripheral surface, the second plurality of holes being distributed circumferentially about the combustor component, the second plurality of holes being axially downstream of the first plurality of holes; and a second plurality of resonators formed with the combustor component, each resonator having a resonator plate and at least one side wall, the resonator plate including a plurality of holes therein, each resonator having an inner cavity defined between the resonator plate, the at least one side wall and the outer peripheral surface of the combustor component, the at least one side wall of each resonator surrounding a subset of the second plurality of holes, the second plurality of resonators being substantially circumferentially aligned about the combustor component to form a second row of resonators.

7. The resonator system of claim 6 wherein each resonator in the first row of resonators has substantially the same circumferential clocking position as a respective one of the resonators in the second row of resonators, whereby the resonators in the first row are substantially aligned with the resonators in the second row.

8. The resonator system of claim 6 wherein each resonator in the first row of resonators has a different circumferential clocking position than a respective one of the resonators in the second row of resonators, whereby the resonators in the first row are offset from the resonators in the second row.

9. The resonator system of claim 6 wherein the resonators in the first row of resonators collectively have an associated first damping characteristic with an associated frequency response and wherein the resonators in the second row of resonators collectively have an associated second damping characteristic with an associated frequency response, wherein the first damping characteristic is different from the second damping characteristic.

10. The resonator system of claim 6 wherein the second row of resonators includes a plurality of high flow resonators and low flow resonators, wherein the rate of flow through the high flow resonators is from 1.5 to 5times the rate of flow through the low flow resonators.

11. The resonator system of claim 1, wherein each high flow resonator of the first plurality of resonators is positioned to be substantially circumferentially centered in each respective relatively hot region.

12. The resonator system of claim 1, wherein an upstream side of each resonator of the first plurality of resonators extends across the respective relatively hot region and into each of respective relatively cold regions abutting the respective relatively hot region, effective to provide film cooling under a portion of the at least one side wall that is outside the respective relatively hot region.

13. A resonator system for a turbine engine comprising:

a combustor component having an outer peripheral surface and an inner peripheral surface, a first plurality of holes extending through the combustor component from the outer peripheral surface to the inner peripheral surface, the first plurality of holes being distributed circumferentially about the combustor component, a second plurality of holes extending through the combustor component from the outer peripheral surface to the inner peripheral surface, the second plurality of holes being distributed circumferentially about the combustor component, the second plurality of holes being located axially downstream of the first plurality of holes;

a fluid flow within the combustor component, the fluid proximate to the inner peripheral surface of the combustor component comprising relatively hot regions alternating with relatively cold regions in the circumferential direction about the inner peripheral surface of the combustor component, a first plurality of resonators formed with the combustor component, the first plurality of resonators being substantially circumferentially aligned about the combustor component to form a first row of resonators, each resonator having a resonator plate and at least one side wall, the resonator plate including a plurality of holes therein, each resonator having an inner cavity defined between the resonator plate, the at least one side wall and the outer peripheral surface of the combustor component, the at least one side wall of each resonator surrounding a subset of the first plurality of holes in the combustor component wherein a portion of the first plurality of resonators are first high flow resonators, wherein each first high flow resonator is formed in a location that is substantially aligned with one of the relatively hot regions, and wherein a portion of the first plurality of the resonators are first low flow resonators, wherein each first low flow resonator is formed in a location that is substantially aligned with one of the relatively cold regions.; and a second plurality of resonators formed with the combustor component, the second plurality of resonators being substantially circumferentially aligned about the combustor component to form a second row of resonators, each resonator having a resonator plate and at least one side wall, the resonator plate including a plurality of holes therein, each resonator having an inner cavity defined between the resonator plate, the at least one side wall and the outer peripheral surface of the combustor component, the at least one side wall of each resonator surrounding a subset of the second plurality of holes in the combustor component, wherein a portion of the second plurality of resonators are second high flow resonators, wherein each second high flow resonator is formed in a location that is substantially aligned with one of the relatively hot regions, and wherein a portion of the second plurality of the resonators are second low flow resonators, wherein each second low flow resonator is formed in a location that is substantially aligned with one of the relatively cold regions, wherein each resonator in the first row of resonators has a different circumferential clocking position than a respective one of the resonators in the second row of resonators, whereby the resonators in the first row are offset from the resonators in the second row.

14. The resonator system of claim 13 wherein the resonator plate of each of the first plurality of resonators and the resonator plate of each of the second plurality of resonators are one of generally trapezoidal, parallelogrammatic, rectangular, circular, oval, elliptical or triangular in conformation.

15. The resonator system of claim 13 wherein a resonator in the second row is offset from a resonator in the first row by about one half of a circumferential width of the resonator in the first row.

16. The resonator system of claim 13 wherein the resonators in the first row of resonators collectively have an associated first damping characteristic with an associated frequency response and wherein the resonators in the second row of resonators collectively have an associated second damping characteristic with an associated frequency response, wherein the first damping characteristic is different from the second damping characteristic.

17. The resonator system of claim 13 wherein the combustor component is a combustor liner.

18. The resonator system of claim 13 wherein the first plurality of resonators are arranged so that there is at least one high flow resonator associated with each hot region and at least one low flow resonator associated with each cold region, whereby the at least one high flow resonator alternates with the at least one low flow resonator about the outer peripheral surface of the combustor component.

* * * * *